US006580954B1

(12) United States Patent
Shea

(10) Patent No.: US 6,580,954 B1
(45) **Date of Patent: *Jun. 17, 2003**

(54) BOWLING CENTER SYSTEM

(76) Inventor: Michael J. Shea, 1726 Creek Crossing Rd., Vienna, VA (US) 22182

( * ) Notice: Subject to any disclaimer, the term of this patent is extended or adjusted under 35 U.S.C. 154(b) by 0 days.

This patent is subject to a terminal disclaimer.

(21) Appl. No.: 10/086,247

(22) Filed: Mar. 4, 2002

Related U.S. Application Data

(63) Continuation of application No. 09/185,743, filed on Nov. 4, 1998, now Pat. No. 6,430,453.

(60) Provisional application No. 60/064,180, filed on Nov. 4, 1997.

(51) Int. Cl.[7] ..... G06F 155/00

(52) U.S. Cl. ..... 700/91; 473/70; 473/54; 340/323 B; 463/42

(58) Field of Search ..... 700/91; 473/70; 340/323 B; 463/42; 273/108, 236–237, 370–371, 473, 101–102, 54, 64, 67, 131, 407, 409, 434, 247, 249, 252, 273, 238, 242, 348, 372–376, 700, 92–93, 463, 9–13, 16–20, 25, 40–41

(56) References Cited

U.S. PATENT DOCUMENTS

| | | | |
|---|---|---|---|
| RE30,467 | E | 12/1980 | House et al. |
| RE30,471 | E | 1/1981 | Reynolds |
| 4,302,010 | A | 11/1981 | Kaenel |
| 4,754,967 | A | 7/1988 | Edler et al. |
| 4,824,109 | A | 4/1989 | Cervantes |
| 5,083,271 | A | 1/1992 | Thacher et al. |
| 5,101,354 | A | 3/1992 | Mowers et al. |
| 5,118,105 | A | 6/1992 | Brim et al. |
| 5,198,976 | A | 3/1993 | Form et al. |
| 5,241,379 | A | 8/1993 | Tsujita |
| 5,450,318 | A | 9/1995 | Mowers et al. |
| 5,618,238 | A | 4/1997 | Kruse et al. |
| 5,628,693 | A | 5/1997 | Mowers et al. |
| 5,683,080 | A | 11/1997 | Vaioli et al. |
| 5,709,607 | A | 1/1998 | Mowers et al. |
| 5,719,548 | A | 2/1998 | Stirling et al. |
| 5,842,929 | A | 12/1998 | Moody et al. |
| 5,857,912 | A | 1/1999 | Freitag |
| 5,882,258 | A | 3/1999 | Kelly et al. |
| 5,917,725 | A | 6/1999 | Thacher et al. |
| 5,970,143 | A | 10/1999 | Schneier et al. |
| 5,971,849 | A | 10/1999 | Falciglia |
| 6,015,344 | A | 1/2000 | Kelly et al. |
| 6,304,789 | B1 | 10/2001 | Shea |
| 6,322,365 | B1 | 11/2001 | Shechter et al. |
| 6,430,453 | B1 | 8/2002 | Shea |
| 2002/0010032 | A1 * | 1/2002 | Stiteler ..... 473/54 X |

* cited by examiner

*Primary Examiner*—S. Thomas Hughes
*Assistant Examiner*—Chanda L. Harris

(57) ABSTRACT

A system adapted for use in permitting a bowling game between bowlers at remotely located bowling centers includes pin fall sensors at each bowling center for sensing pin falls caused by balls bowled to knock down pins. Communication circuitry at each bowling center is configured to send locally generated scoring data based on the pin falls to a remotely located bowling center and to receive remotely generated scoring data from the remotely located bowling center. Display devices at each bowling center display the locally generated scoring data and the remotely generated scoring data.

17 Claims, 1 Drawing Sheet

BOWLING CENTER SYSTEM

RELATED APPLICATION

This present application is a continuation of U.S. patent application Ser. No. 09/185,743, filed Nov. 4, 1998, now U.S. Pat. No. 6,430,453 B1 which claims benefit of the priority of U.S. Provisional Application Ser. No. 60/064,180, filed Nov. 4, 1997, the contents of which are incorporated herein in their entirety.

TECHNICAL FIELD

The present invention generally relates to bowling center systems and, more particularly, to bowling center systems that communicate with each other to transmit and receive data such as scoring data and audio and video data.

BACKGROUND OF THE INVENTION

As described in U.S. Pat. No. 5,101,354, bowling center systems generally include a plurality of pairs of bowling lanes, with each lane including an automatic pinsetter. The automatic pinsetter is operable to automatically control pinsetter cycles within a bowling game. Under automatic control, the pinsetter at the beginning of each frame sets ten pins on the deck. The bowler is permitted to roll a maximum of two balls to attempt to knock down all of the pins. The frame ends after all of the pins are knocked down or after two balls are rolled, whichever occurs first. The game consists of ten such frames.

These systems generally include automatic scoring systems which are coupled to both pinsetters in a lane pair for automatically processing pin fall information for the two lanes and displaying bowler's scores on scoring system monitors and on overhead displays such as CRT displays. Suitable interconnections are provided between the scoring system and pinsetter so that pin fall information can be transmitted from pin fall sensing devices associated with the pinsetter to the scoring system.

Bowling center systems also generally include a manager's control system in electrical communication with the scoring systems. The function of the manager's control system is to provide administrative control over the operation of the automatic pinsetters and the scoring systems. For example, the manager's control system is utilized to provide lane status report information, to upload the video score display from any scoring system and to provide score correction for a particular scoring system. The manager's control console also included provision for causing messages to be displayed at a preselected scoring system, to transfer lane scoring information from one scoring system to another, and provide for tournament display by displaying a pair of lane scores on any selected number of overhead CRT's.

While bowling is a popular participation sport, it is nonetheless desirable to develop new games and manner of competition in order to maintain and expand the sport's popularity.

SUMMARY OF THE INVENTION

In accordance with one aspect of the invention, a system adapted for use in permitting a bowling game between bowlers at remotely located bowling centers is provided. The system includes pin fall sensors at each bowling center for sensing pin falls caused by balls bowled to knock down pins. Communication circuitry at each bowling center is configured to send locally generated scoring data to a remotely located bowling center and to receive remotely generated scoring data from the remotely located bowling center. Display devices at each bowling center display the locally generated scoring data and the remotely generated scoring data.

In accordance with another aspect of the invention, a method is provided for permitting a bowling game between bowlers at remotely located bowling centers. The method includes sensing pin falls caused by caused by balls bowled to knock down pins; sending locally generated scoring data to a remotely located bowling center and receiving remotely generated scoring data from the remotely located bowling center; and displaying the locally generated scores and the remotely generated scores.

The features and advantages of the present invention will be better understood from a reading of the following detailed description in conjunction with the accompanying drawings.

DETAILED DESCRIPTION

Figure 1:
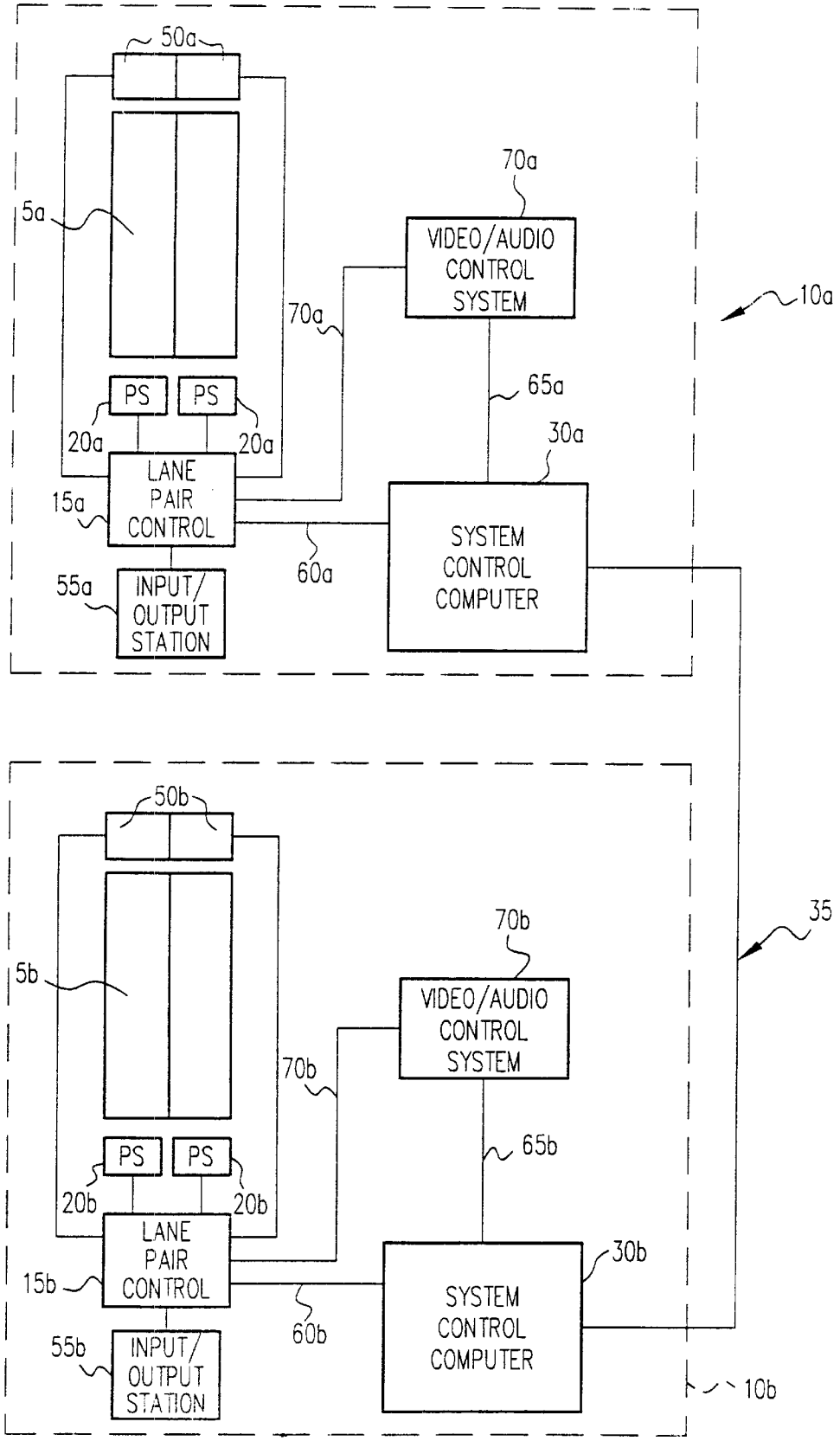
FIG. 1 is a diagram of a bowling center system in accordance with the present invention.

FIG. 1 is a block diagram of a bowling center system in accordance with the present invention and shows portions of two bowling centers ("houses") 10*a*, 10*b*. Each of the bowling centers is generally configured along the lines of a conventional bowling center such as the one described in U.S. Pat. No. 5,101,354, the contents of which are incorporated herein.

Each bowling center includes a plurality of lanes, wherein the lanes are grouped into lane pairs. Thus, lanes 1 and 2 are a first lane pair, lanes 3 and 4 are a second lane pair, etc. A pinsetter is associated with each lane and the two pinsetters of each lane pair are connected to a corresponding lane pair control system. Each lane pair control system controls the operation of both of the pinsetters connected thereto and provides automatic scoring for bowling games played on the associated lanes. For example, for league bowling, the lane pair control system may operate the pinsetters connected thereto so that a cross lane bowling game is played on the two lanes, while for open bowling, the lane pair control system may operate the pinsetters connected thereto so that separate games may be played on each lane.

For purposes of clarity, FIG. 1 shows the elements associated with a single lane pair of each of bowling centers 10*a* and 10*b*. A lane pair control system 15*a* is associated with a lane pair 5*a* at bowling center 10*a* and a lane pair control system 15*b* is associated with a lane pair 5*b* at bowling center 10*b*. Each lane of lane pair 5*a* includes an automatic pinsetter 20*a* and each lane of lane pair 5*b* includes an automatic pinsetter 20*b*. Pinsettters 20*a* are connected to lane pair control system 15*a* and pinsetters 20*b* are connected to lane pair control system 15*b*. Each lane pair control system 15*a*, 15*b* is connected to corresponding display units 50*a*, 50*b* for displaying information such as bowler line-up and bowler scoring data to bowlers. Although FIG. 1 shows two display units 50 connected to each lane pair control system, the invention is not limited in this respect. Lane pair control systems 15*a*, 15*b* automatically process pin fall data provided by pin fall detectors of pinsetters 20*a*, 20*b*. The lane pair control systems control the associated displays to display scores based on the pin fall data. More specifically, the pin fall detectors (such an optical detector) detects the number of pins knocked down when a bowler rolls a ball down the alley and the bowlers score is generally based on the number pins knocked down. The pin fall data generated by the pin fall detector is supplied to lane pair control system and the lane pair control system automatically computes the bowlers' scores and causes the scores to be displayed in a suitable format on the one or more displays.

Each lane pair control system 15*a*, 15*b* is also connected to a corresponding bowler data input/output station 55*a*, 55*b*. Bowler data input stations 55*a*, 55*b* permit bowlers to input data such as bowler names and line-ups for bowling games. Each bowler input station may include an input device 45, such as a keypad, for permitting bowlers to enter, for example, appropriate bowler identification information (e.g., bowler names), handicap information, game type information (open bowling, league bowling, inter-house bowling, etc.), and the like.

All of the lane pair control systems of bowling center 10*a* (including lane pair control system 15*a*) are connected to a system control computer 30*a* over communication line 60*a* and all of the lane pair control systems of bowling center 10*b* (including lane pair control system 15*b*) are connected to a system control computer 30*b* over communication line 60*b*. System control computers 30*a*, 30*b* provide administrative control for the lane pair control systems of the corresponding bowling centers including accounting control and the downloading of game information to the lane pair control systems. System control computers 30*a*, 30*b* communicate over local communication lines 65*a*, 65*b* to video/audio control systems 70*a*, 70*b*. Video/audio control systems 70*a*, 70*b* are connected over video/audio distribution lines 75*a*, 75*b* to each of the lane pair control systems. The video/audio control systems are responsive to commands from the system control computers to transmit video/audio information to the lane pair control systems for subsequent display on display units 50*a*, 50*b* and output via speakers (not shown).

System control computers 30*a*, 30*b* communicate with each other via a communication link 35. Communication link 35 may be any suitable wired or wireless communication link for communicating data between the system control computers including, but not limited to, telephone, coaxial, fiber optic, hybrid fiber coax (HFC) and satellite links. The system control computers of each of the bowling centers are provided with or connected to any conventional communication equipment necessary for establishing the communication link, e.g., RF transmitter(s)/receiver(s), satellite transmitter(s)/receiver(s), modem(s), optical transmitter(s)/receiver(s), etc. In one implementation, the system control computers 30*a*, 30*b* may execute applications for establishing a connection with each other over the internet. In addition, although FIG. 1 shows two bowline centers connected together, the invention is not limited in this respect and any number of bowling centers may be connected together.

It is contemplated that bowling centers 10*a*, 10*b* may be arranged in different parts of the same city; in different cities; in different states: or even in different countries. In accordance with one aspect of the present invention, scoring data generated from pin fall data at bowling center 10*a* is communicated to bowling center 10*b*. Similarly, scoring data generated from pin fall data at bowling center 10*b* is communicated to bowling center 10*a*. In the arrangement shown in FIG. 1, lane pair control system 15*a* is configured to generate a display on displays 50*a* of scoring data based on pin fall data from the pinsetters 20*a* connected thereto. Lane pair control system 15*a* is further configured to communicate this same locally generated scoring data to system control computer 30*a*. System control computer 30*a* then communicates the scoring data to system control computer 30*b* via communication link 35. System control computer 30*b* then provides the scoring data to lane pair control system 15*b* which is configured to generate a display on the displays 50*b* of the scoring data communicated from the bowling center 10*a*. In a similar manner, lane pair control system 15*b* is configured to generate a display on displays 50*b* of scoring data based on pin fall data from the pinsetters 20*b* connected thereto. Lane pair control system 15*b* is further configured to communicate this same locally generated scoring data to system control computer 30*b*. System control computer 30*b* then communicates the scoring data to system control computer 30*a* via communication link 35. System control computer 30*a* then provides the scoring data to lane pair control system 15*a* which is configured to generate a display on the displays 50*a* of the scoring data communicated from the bowling center 10*b*.

The above-described system can be utilized to permit competition between bowlers simultaneously bowling at remotely located bowling centers 10*a*, 10*b*. That is, one or more bowlers at one bowling center 10*a* can compete in real-time against one or more bowlers at remotely located bowling center 10*b*. The system control computers of the respective bowling centers configure the lane pair control systems of lanes on which the competing bowlers will bowl for "inter-house bowling" and the competing bowlers at each bowling center then begin bowling. As the bowlers at bowling center 10*a* bowl, the locally generated pin fall data is used to generate scoring data which is displayed on displays 50*a* for viewing by the bowlers at bowling center 10*a*. The scoring data is also communicated via communication link 35 to bowling center 10*b* as described above and is displayed on displays 50*b* for viewing by the competing bowlers at bowling center 10*b*. Similarly, as the bowlers at bowling center 10*b* bowl, the locally generated pin fall data is used to generate scoring data which is displayed on displays 50*b* for viewing by the bowlers at bowling center 10*b*. The scoring data is also communicated via communication link 35 to bowling center 10*a* as described above and is displayed on displays 50*a* for viewing by the competing bowlers at bowling center 10*a*. In this way, the respective bowlers at each of the bowling centers are presented with displays of their own scoring data and of the scoring data of their remotely located competitors. Thus, the bowlers at each bowling center can keep track of their own scores and of the scores of their competitors in real time.

In accordance with the system of the present invention, league bowling between teams at different locations may take place in real time. In addition, real-time tournaments on a regional, state-wide, or even nationwide level may take place.

The data which is communicated between bowling centers is not limited to scoring data. For example, video and/or audio data may also be communicated in order to further enhance the sense of competition. For example, each bowlins center one or more cameras may be arranged for transmitting video data showing the bowlers at the other bowling center. The video may be displayed on a display that is separate from the display used for displaying the scoring data. Alternatively, a single display may have a split screen or "picture-in-picture" arrangement in order to show both the scoring data and video data. A single camera may be positioned for a "long shot" to show the bowler's approach and the roll of the ball. Alternatively, separate cameras may be arranged to show different aspects, e.g., one camera may be positioned to show the bowler's approach while another camera may be used to show the roll of the ball. The video from more than one camera may be displayed simultaneously in a split screen or picture-in-picture arrangement, alternately on the same display, or on a corresponding number of separate displays. One or more microphones may also be arranged to pick up the sounds of the bowlers. The audio and video data is appropriately communicated to the remotely located system control computer and supplied to the lane pair control system via the video/audio control system for display on displays 50 (or some other displays) and output via speakers (not shown).

While the invention is described above in terms of the system control computers being linked together via a communication link it will be appreciated that a communication link may also be directly established between the lane pair control systems for the lanes on which the competing bowlers will bowl.

In addition, while the above embodiment communicates scoring data between bowling centers, the pin fall data may be communicated between the bowling centers and the lane pair control systems can utilize the pin fall data communicated thereto from the remote bowling center to generate the scoring data.

The data communicated between the bowling centers may also include pin configuration data indicative of the pin configuration faced by a particular bowler. This pin configuration data can be utilized to generate displays of the pin configurations faced by the competing bowlers at the remote locations.

While there has been shown and described various embodiments of the present invention, it will be evident to those skilled in the art that various modifications may be made thereto without departing from the scope of the invention which is set forth in the appended claims.

I claim:

1. A bowling game method involving a first bowler bowling at a first bowling center and a second bowler bowling at a second bowling center located remotely with respect to the first bowling center, the method comprising:

detecting pinfalls for the first bowler at the first bowling center and detecting pinfalls for the second bowler at the second bowling center;

generating scores for the first bowler at the first bowling center based on the corresponding detected pinfalls and generating scores for the second bowler at the second bowling center based on the corresponding detected pinfalls;

communicating the scores of the first bowler from the first bowling center to the second bowling center and communicating the scores of the second bowler from the second bowling center to the first bowling center; and displaying the scores of the first and second bowlers at the first bowling center while the first bowler bowls and at the second bowling center while the second bowler bowls.

2. The method according to claim 1, further comprising:

capturing video of the first bowler at the first bowling center and capturing video of the second bowler at the second bowling center;

communicating the video of the first bowler from the first bowling center to the second bowling center and communicating the video of the second bowler from the second bowling center to the first bowling center; and displaying the video of the first bowler at the second bowling center and displaying the video of the second bowler at first bowling center.

3. The method according to claim 1, further comprising:

capturing audio of the first bowler at the first bowling center and capturing audio of the second bowler at the second bowling center;

communicating the audio of the first bowler from the first bowling center to the second bowling center and communicating the audio of the second bowler from the second bowling center to the first bowling center; and outputting the audio of the first bowler at the second bowling center and outputting the audio of the second bowler at first bowling center.

4. The method according to claim 1, wherein the scores of the first and second bowlers are communicated over a wired communication link.

5. The method according to claim 1, wherein the scores of the first and second bowlers are communicated over a wireless communication link.

6. A system at a first bowling center allowing a bowling game involving a first bowler bowling at the first bowling center and a second bowler bowling at a second bowling center located remotely with respect to the first bowling center, the system comprising:

a pinfall detector;

a scoring system for generating scores for the first bowler based on pinfall data from the pinfall detector;

one or more display devices; and a communication circuit connected to a communication link for sending the scores of the first bowler to the second bowling center and for receiving scores of the second bowler sent from the second bowling center, wherein the one or more display devices displays the scores for the first and second bowlers while the first bowler bowls.

7. The system according to claim 6, wherein the communication link is a wireless communication link.

8. The system according to claim 6, wherein the communication link is a wired communication link.

9. The system according to claim 6, wherein the communication circuit receives video of the second bowler sent from the second bowling center and the one or more display devices displays the received video.

10. The system according to claim 6, wherein the communication circuit receives pin configurations for the second bowler sent from the second bowling center and the one or more display devices displays the received pin configurations.

11. The system according to claim 6, further comprising speakers.

12. The system according to claim 11, wherein the communication circuit receives audio of the second bowler sent from the second bowling center and the speakers output the received audio.

13. A system allowing a bowling game involving a first bowler bowling at a first bowling center and a second bowler bowling at a second bowling center located remotely with respect to the first bowling center, the system comprising:

a pinfall detector at each of the first and second bowling centers;

a scoring system at each of the first and second bowling centers for generating scores based on pinfall data from the corresponding pinfall detector;

one or more display devices at each of the first and second bowling centers; and a communication circuit at each of the first and second bowling centers, the communication circuit at the first bowling center sending the scores of the first bowler over a communication link to the second bowling center and receiving the scores of the second bowler sent over the communication link from the second bowling center, and the communication circuit at the second bowling center sending the scores of the second bowler over the communication link to the first bowling center and receiving the scores of the first bowler sent over the communication link from the first bowling center, wherein the one or more display devices at the first bowling center displays the scores for the first and second bowlers while the first bowler is bowling and the one or more display devices at the second bowling center displays the scores for the first and second bowlers while the second bowler is bowling.

14. The system according to claim 13, wherein the communication link is a wireless communication link.

15. The system according to claim 13, wherein the communication link is a wired communication link.

16. The system according to claim 13, further comprising:

a camera at each of the first and second bowling centers for capturing video of the first and second bowlers, wherein the communication circuit at the first bowling center sends the video of the first bowler to the second bowling center over the communication link and receives the video of the second bowler sent from the second bowling center over the communication link, and the communication circuit at the second bowling center sends the video of the second bowler to the first bowling center over the communication link and receives the video of the first bowler sent from the first bowling center over the communication link, and the one or more display devices at the first bowling center displays the video of the second bowler and the one or more display devices at the second bowling center displays the video of the first bowler.

17. The system according to claim 13, further comprising:

a microphone at each of the first and second bowling centers for capturing audio of the first and second bowlers; and speakers at each of the first and second bowling centers, wherein the communication circuit at the first bowling center sends the audio of the first bowler to the second bowling center over the communication link and receives the audio of the second bowler sent from the second bowling center over the communication link, and the communication circuit at the second bowling center sends the audio of the second bowler to the first bowling center over the communication link and receives the audio of the first bowler sent from the first bowling center over the communication link, and the speakers at the first bowling center output the audio of the second bowler and the speakers at the second bowling center output the audio of the first bowler.

* * * * *